United States Patent [19]

Hudson

[11] Patent Number: 4,865,373

[45] Date of Patent: Sep. 12, 1989

[54] SNOW SHOVEL

[76] Inventor: Barry C. Hudson, 714 Rugby Rd., Phillipsburg, N.J. 08865

[21] Appl. No.: 208,755

[22] Filed: Jun. 20, 1988

[51] Int. Cl.[4] ..... E01H 5/02

[52] U.S. Cl. ..... 294/54.5; 37/270; 37/285; 294/57; 294/59

[58] Field of Search ..... 294/49, 54.5, 57, 59; 37/124, 126 R, 126 A, 130, 265–267, 270, 271, 278, 284, 285; 254/131.5; 280/47.17, 47.2, 47.24, 47.26, 47.34, 47.35

[56] References Cited

U.S. PATENT DOCUMENTS

| | | | |
|---|---|---|---|
| 928,283 | 7/1909 | Schultze | 294/49 |
| 1,206,235 | 12/1915 | Luther | 294/59 |
| 1,207,472 | 12/1916 | Barton | 294/54.5 |
| 1,232,361 | 7/1917 | Mills | 294/59 |
| 2,460,560 | 2/1949 | Williams | 37/271 X |
| 2,598,952 | 6/1952 | Weingart | 294/54.5 |
| 2,772,490 | 12/1956 | Hnastchenko | 37/284 |
| 2,823,470 | 2/1958 | Page | 37/265 |
| 2,846,785 | 8/1958 | Underwood | 294/54.5 X |
| 2,852,872 | 9/1958 | Benz | 294/59 UX |
| 2,930,152 | 5/1958 | Pipkin | 294/54.5 |
| 3,643,356 | 2/1972 | Gohl | 37/271 X |
| 3,661,414 | 5/1972 | Roth | 294/59 |
| 4,214,385 | 7/1980 | Baranowski et al. | 294/59 X |
| 4,559,726 | 7/1985 | Moisan | 37/267 |

FOREIGN PATENT DOCUMENTS

| | | | |
|---|---|---|---|
| 222164 | 7/1962 | Austria | 37/270 |
| 1534150 | 6/1969 | Fed. Rep. of Germany | 37/270 |
| 3503328 | 8/1986 | Fed. Rep. of Germany | 37/265 |

*Primary Examiner*—Johnny D. Cherry
*Attorney, Agent, or Firm*—John J. Selko

[57] ABSTRACT

A manually-operated snow shovel has wheels in front of and behind the blade, to position the blade at an angle between 30 degrees and 35 degrees with the horizontal. An angularly bent handle positions grips at about waist height, to permit a person to roll the shovel on the surface being cleaned.

5 Claims, 3 Drawing Sheets

FIG. 5
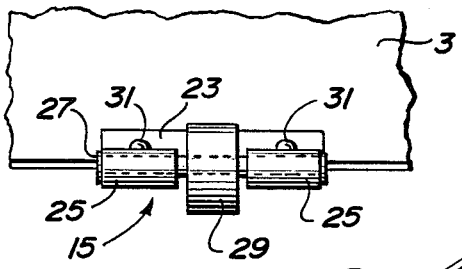
FIG. 4
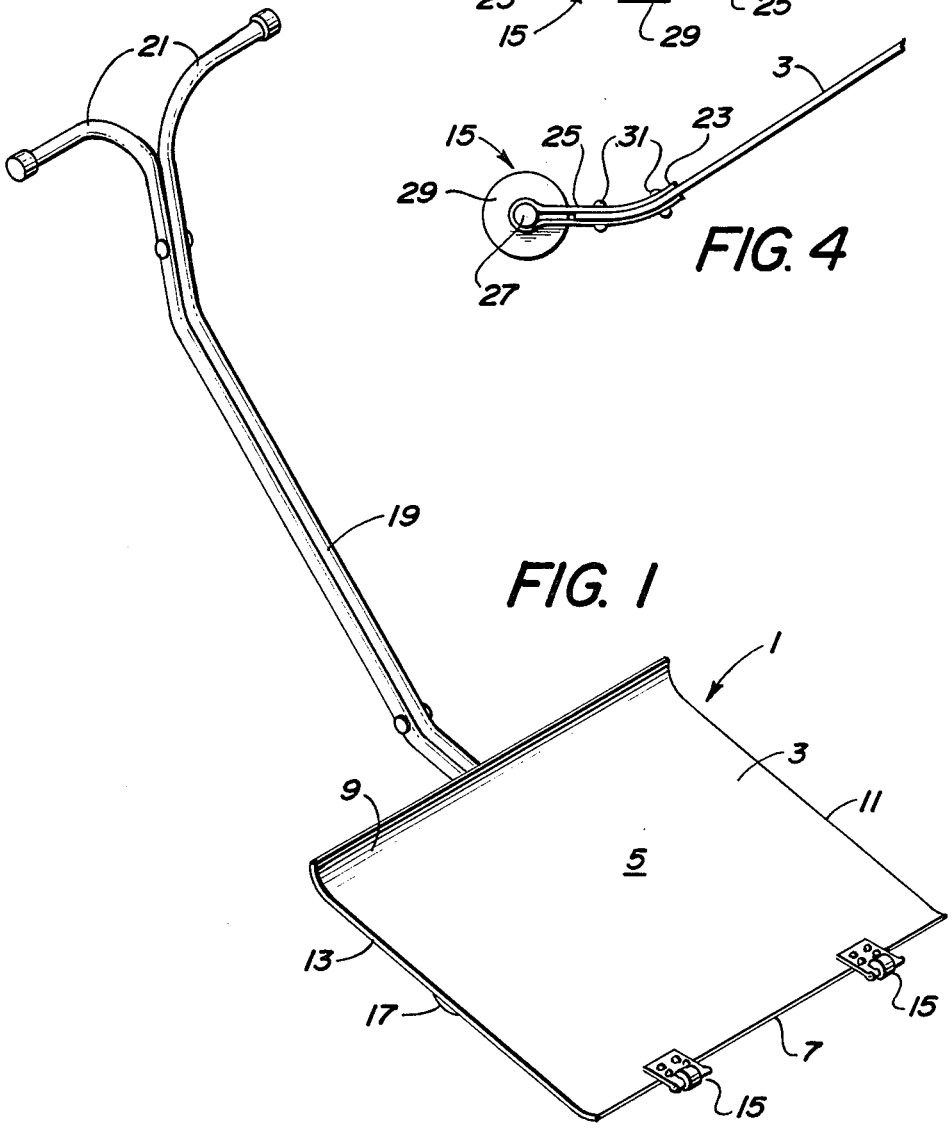
FIG. 1

SNOW SHOVEL

FIELD OF INVENTION

This invention relates to manually operated snow shovels, and more particularly, wheeled snow shovels.

PRIOR ART

Prior art manually operated snow shovels have used wheels to aid the person pushing a load of snow along a horizontal surface in two general approaches. In the first, wheels at the front edge of the shovel blade cause the leading edge of the blade to move over the surface being cleaned without frictionally engaging such surface, thereby saving energy for the person pushing the shovel. However, such shovels still require the person to manually support the weight of snow, as it accumulates on the blade, during the course of forward movement of the shovel.

The second approach uses wheels behind the blade face to support the load on the blade face. Such shovels do not completely keep the front edge of the blade from frictionally engaging the surface being cleaned. There is a need, therefore, for a snow shovel which prevents the leading edge from engaging the surface being cleaned, while at the same time, supporting the weight of snow on the blade.

OBJECT OF THE INVENTION

It is therefore an object of this invention to provide a hand-operated snow shovel which prevents the leading edge of the blade from frictionally engaging the surface being cleaned, while at the same time supporting the weight of snow on the blade. It is a further object of this invention to provide such a shovel which positions the blade at a critical range of angle with the horizontal surface being cleaned, which angle range is most effective for supporting snow on the blade, while enhancing movement of the shovel through the snow, thereby minimizing overall effort required for a given cleaning stroke.

BRIEF DESCRIPTION OF THE DRAWINGS

FIG. 1 is a perspective view of the snow shovel.

FIG. 4 is a view along lines 4—4 of FIG. 3.

FIG. 5 is a view along lines 5—5 of FIG. 2.

DESCRIPTION OF THE PREFERRED EMBODIMENTS

Figure 2:
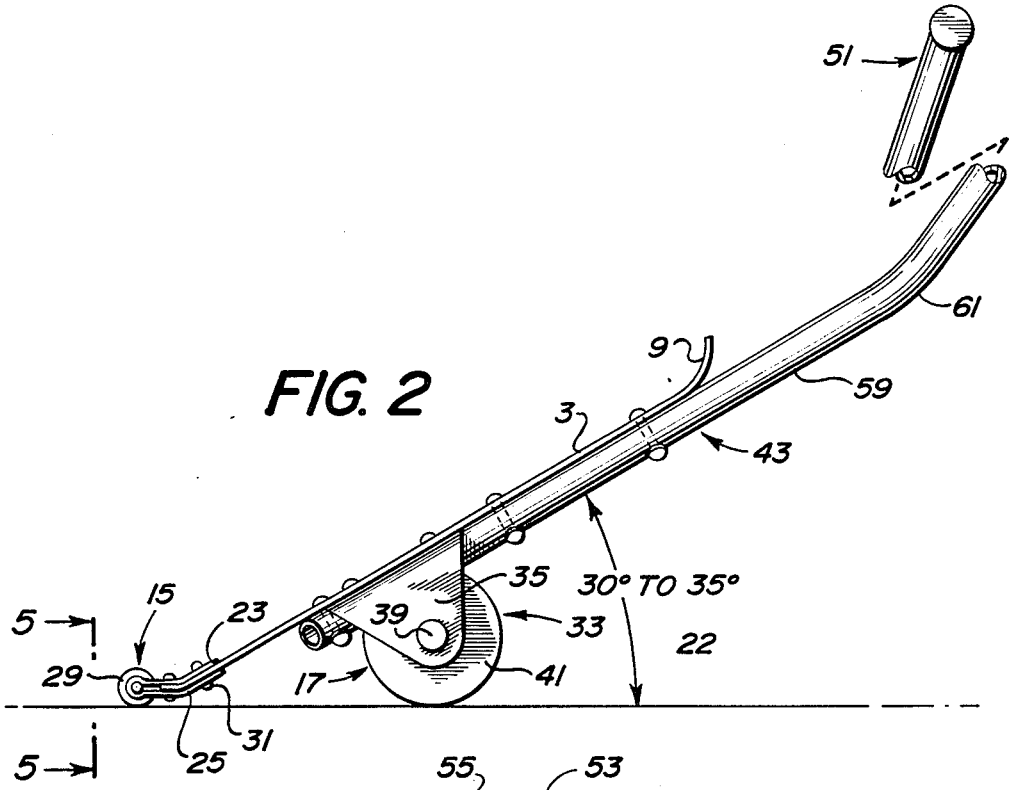
FIG. 2 is a fragmentary side elevation showing the blade, wheel mechanisms, and a handle with one angle therein.

Referring to the drawings, FIG. 1 shows the shovel 1, having a blade 3, with a front face 5 and a rear face 6 (not shown) opposite front face 5. Blade 3 has a leading edge 7 and a rear edge 9 and a pair of side edges 11 and 13 therebetween.

First wheel means 15 is fastened to blade 3, at leading edge 7, and extends in front of blade 3. First wheel means 15 includes a plurality of rollers, which contact and roll along the surface being cleaned. First wheel means 15 keeps leading edge 7 spaced above the surface being cleaned, thereby preventing leading edge 7 from frictionally engaging the surface, as will be more fully described hereinafter.

Second wheel means 17 is fastened to back face 6, and extends downwardly therefrom for contacting and rolling along the surface being cleaned, while supporting the weight of snow on blade 3, as will be more fully described hereinafter.

Handle means 19 is fastened to blade 3 and extends angularly upwardly to position a grip portion 21 at about waist height of an average-size person pushing the shovel.

Referring the FIG. 2, leading edge 7 turns outwardly in advance of blade 3, to become approximately parallel to a horizontal surface therebelow being cleaned. Back edge 9 turns upwardly from blade 3 at an angle of about 90 degrees, to cause snow to "roll" forwardly in front of blade 3, as it moves forward. Blade 3 is shown positioned, by first and second wheel means 15 and 17, at an angle 22 to a horizontal surface, which angle 22 is in the critical range of 30 degrees to 35 degrees, inclusive.

I have discovered that with an angle of less than 30 degrees, snow rides up and over the rear edge 9 of the shovel. With an angle greater than 35 degrees, snow presents increased resistance to movement of the shovel on it wheels, requiring a backward tilting of the blade, which lessens the cleaning ability of the blade. An angle in the critical range as specified provides a proper balance of cleaning and ease of movement, together with the "rolling" action of the snow, as described hereinabove.

As is shown in FIGS. 4 and 5, first wheel means 15 includes a bracket 23 spanning blade 3 and fastened thereto. Bracket 23 has a pair of spaced apart ears 25 that extend forward of leading edge 7. Ears 25 carry a rotatable shaft 27 parallel to, and forward of, leading edge 7, with wheel 29 mounted thereon also forward of leading edge 7. Rivets 31 fasten bracket 23 to blade 3, but welding or nuts and bolts will also work.

I prefer first wheel means 15 to comprise a plurality, preferably two, of such rotatable wheel and bracket combinations as described hereinabove. With two such wheel and bracket combinations, each one is spaced equidistant between an adjacent blade edge, 11 and 13 respectively, and the vertical centerline 14 of blade 3.

Figure 6:
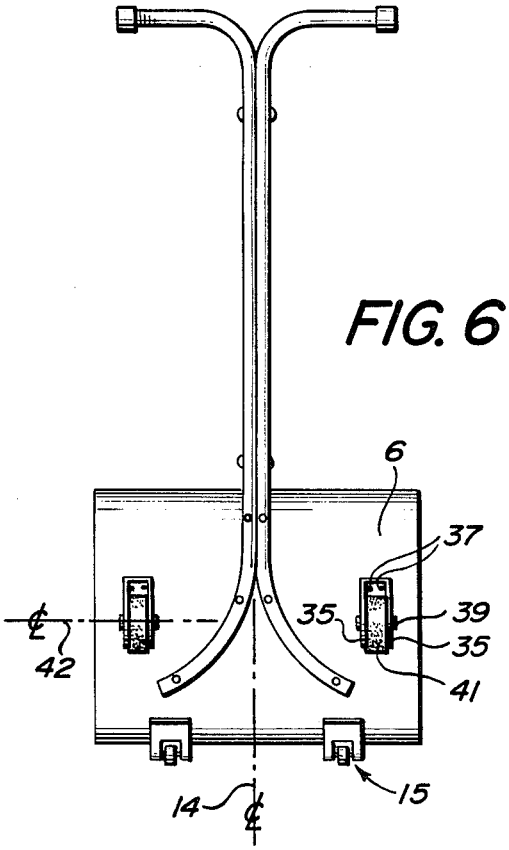
FIG. 6 is a a fragmentary back view of the shovel.

As is shown in FIGS. 2 and 6, second wheel means 17 includes a plurality of wheeled casters 33 comprising a pair of spaced apart arms 35 fastened to back face 6 by means of rivets 37, although welding or nuts and bolts will work. Arms 35 extend downwardly from back face 6 and carry a shaft 39 therebetween. Wheel 41 is rotatably mounted on shaft 39.

I prefer second wheel means 17 to comprise a plurality, preferably two, of such wheeled casters as described hereinabove. With two such casters, each one is spaced at about the horizontal centerline 42 of blade 3, and midway between the adjacent edge, 11 or 13 respectively, and the adjacent wheel and bracket combination forming first wheel means 15.

Figure 3:
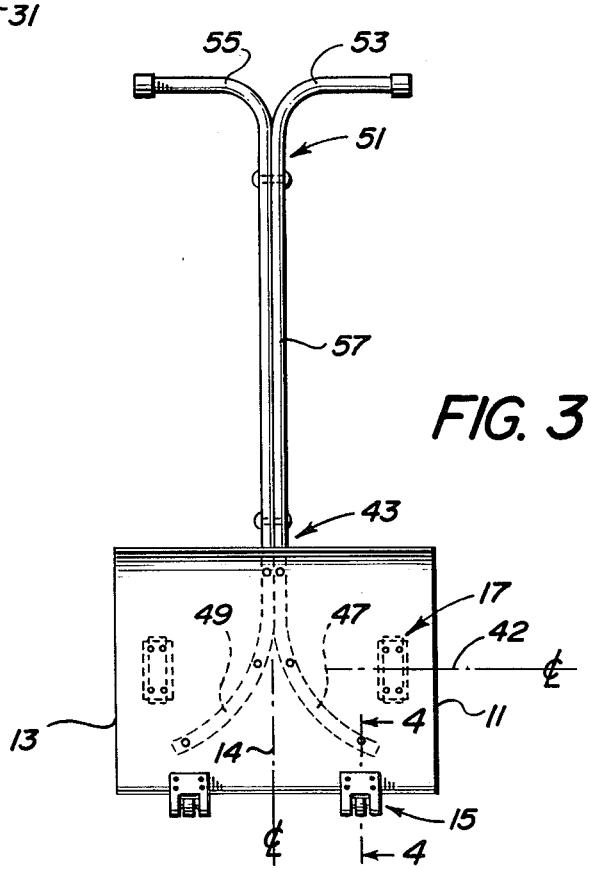
FIG. 3 is a front view of the snow shovel.

As shown in FIGS. 1, 2 and 3, handle means 19 comprises a first end 43 that contacts blade 3 at the vertical centerline 14, and then bifurcates into two support elements 47 and 49, which contact and support blade 3 on either side of vertical centerline 14. The bifurcated end 43 provides support for substantial weight on blade 3.

Handle means 19 includes a second end 51 having a grip portion 21 which is bifurcated into oppositely extending grips 53 and 55. Bifurcated end 51 permits a person's body to press thereagainst, and thereby makes possible application of more force to the shovel.

A shaft 57 extends between first and second ends 43 and 51. Shaft 57 includes a straight portion 59 extending rearwardly and upwardly a short distance from rear edge 9 of blade 3 at the same angle to the horizontal surface as blade 3. Thereafter, shaft 57 includes an angularly bent portion 61, which causes shaft 57 to extend upwardly at a more acute angle. Shaft 57 extends upwardly a sufficient distance to position grips 53 and 55 at a vertical position above the surface being cleaned that is about waist height of an average person, i.e. about 3 to 4 feet. The distance straight portion 59 extends from blade 3 and the angle of bend in portion 61 are selected so that the total horizontal length of the handle and blade is sufficient to permit a normal stride to be taken by the user pushing the shovel without striking the blade 3 with a foot, i.e. about 24 to 36 inches, when grips 53 and 55 are waist height as described hereinabove. In practice, I have successively used a straight portion 59 of about 6 inches and an angle 61 of about 40 degrees, causing shaft 57 to be in the range of 70 to 75 degrees with the horizontal surface. I have shown shaft 57 as two pieces bolted together, but a single member, bifurcated at both ends will work.

Figure 7:
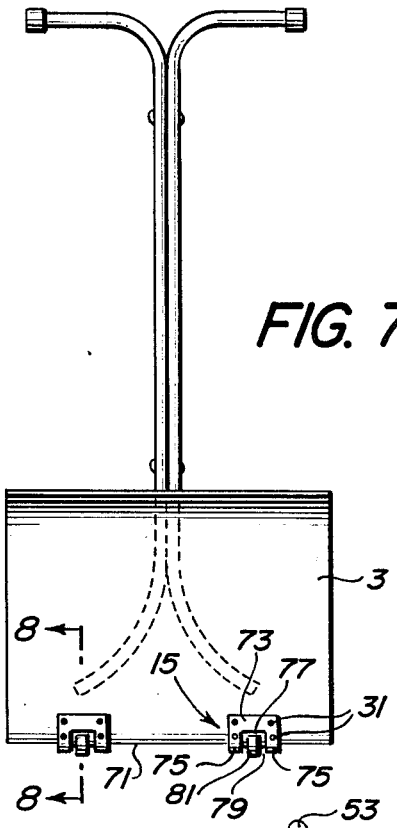
FIG. 7 is fragmentary front view of an alternate embodiment mounting of a first wheel mechanism.
Figure 8:
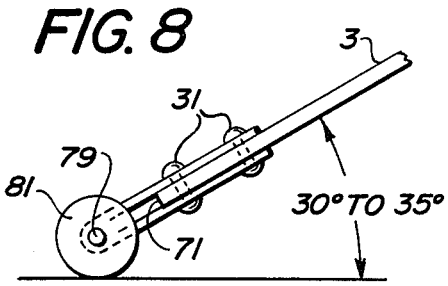
FIG. 8 is a view along lines 8—8 of FIG. 7.

FIGS. 7 and 8 show an alternate embodiment for mounting first wheel means 15. Blade 3 terminates in leading edge 71 at the same angle as blade 3. Bracket 73 is fastened to blade 3 with rivets 31, as before. Spaced apart ears 75 span a slot 77 in blade 3. Ears 75 carry a rotatable shaft 79 parallel to, and in front of, leading edge 71, with wheel 81 mounted thereon. Wheel 81 extends in front of leading edge 71 and within slot 77.

Figure 9:
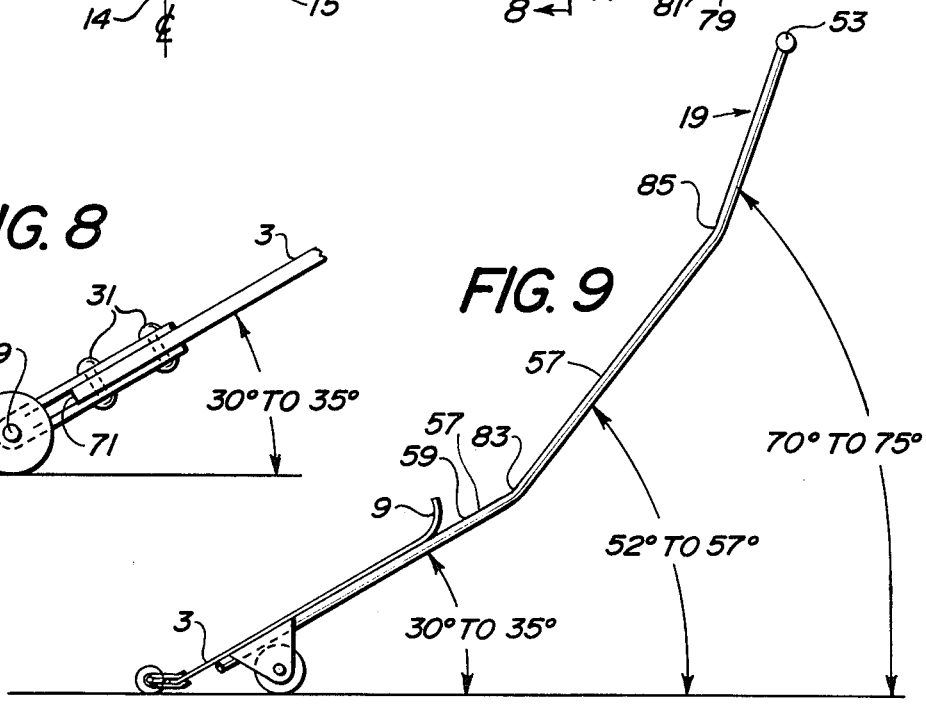
FIG. 9 is a side elevation of an alternate embodiment having a shaft with two angles therein.

FIG. 9 shows an alternate embodiment having handle means 19 with a shaft portion 57 with two angles 83 and 85 therein. Straight portion 59 extends rearwardly and upwardly a short distance (about 6 inches) from rear edge 9 as described hereinabove. Thereafter, shaft 57 includes a first angle 83 of about 22 degrees, causing shaft 57 to be in the range of 52 to 57 degrees with the horizontal surface. Shaft 57 extends upwardly for a short distance (about 24 inches) and thereafter includes a second angle 85 of about 18 degrees, causing shaft 57 to be in the range of 70 to 75 degrees with the horizontal surface. Thereafter, shaft 57 extends upwardly a short distance (about 12 inches) to position grips 53 and 55 a vertical distance above the horizontal surface that is about waist height of an average person.

The waist-height position of grips 53 and 55 resulting from angularly bent handle means 19 permits the shovel 1 to be used as a wheeled carrying device for moving materials other than snow. Shovel 1 can be pivoted back on second wheel means 17 by lowering grips 53 and 55 to about mid-thigh height of the user. This lowering positions blade 3 at about horizontal, while still permitting the user to grasp grips 53 and 55 to push or pull.

I claim:

1. A snow shovel comprising:

a. a blade having a front face, a back face, a leading edge, a rear edge and a pair of side edges therebetween;

b. a first and second wheel means on said blade for contacting and rolling along a horizontal surface, while maintaining said blade at an angle between 30 degrees and 35 degrees with said surface, said first wheel means extending in front of said leading edge, while keeping said leading edge spaced above said surface, said first wheel means further including a plurality of rollers affixed to said blade, each roller including:

i. a pair of spaced apart ears extending in front of said leading edge;

ii. a shaft therebetween parallel to, and in front of said leading edge; and iii. a roller rotatably mounted on said shaft; and c. handle means on said blade for positioning a grip portion about waist high of a person rolling said shovel on said surface.

2. The invention of claim 1, in which said handle means includes:

a. a first end fastened to said back face of said blade;

b. a second end having oppositely extending grips; and;

c. a shaft between said first and second ends, said shaft including an upward angular bend therein, said shaft extending upwardly a sufficient distance so as to position said second end about waist height of a person using said shovel.

3. The invention of claim 2, in which said shaft of said handle means includes two angles therein, the first angle being about 22 degrees, and the second angle being about 18 degrees.

4. A snow shovel comprising:

a. a blade having a front face, a back face, a leading edge, a rear edge and a pair of side edges therebetween;

b. a first and second wheel means on said blade for contacting and rolling along a horizontal surface, while maintaining said blade at an angle between 30 degrees and 35 degrees with said surface, said first wheel means extending in front of said leading edge, while keeping said leading edge spaced above said surface, said second wheel means fastened to said back face of said blade, and extending downwardly therefrom for contacting and rolling along said surface, said second wheel means further including a plurality of casters, each said caster including:

i. a pair of spaced apart arms downwardly extending from said back face;

ii. a shaft therebetween; and iii. a wheel rotatably mounted on said shaft; and c. handle means on said blade for positioning a grip portion about waist high of a person rolling said shovel on said surface.

5. A snow shovel comprising:

a. a blade having a front and back face, a leading edge, a rear edge and a pair of side edges therebetween;

b. first wheel means fastened to said blade, extending in front of said leading edge for contacting and rolling on a horizontal surface, while keeping said leading edge spaced above said surface;

c. second wheel means fastened to said back face of said blade, extending downwardly therefrom, for contacting and rolling on said surface;

d. said first and second wheel means, when contacting said surface, causing said blade to be supported at an angle between 30 degrees and 35 degrees with said surface; and e. handle means comprising:

i. a first end fastened to said blade;

ii. a second end having oppositely extending grips;

iii. a shaft between said first and second ends, said shaft including two upward angular bends therein, a first angular bend at about 22 degrees and a second angular bend at about 18 degrees, said shaft extending upwardly a sufficient distance to position said grips about waist height on a person using said shovel.

* * * * *